US007321747B2

(12) United States Patent
Sanpei et al.

(10) Patent No.: US 7,321,747 B2
(45) Date of Patent: Jan. 22, 2008

(54) FIXING DEVICE AND IMAGE FORMING APPARATUS USING THE SAME

(75) Inventors: Kouichi Sanpei, Ebina (JP); Hiroshi Nou, Ebina (JP); Akira Iwaishi, Ebina (JP); Mitsuhiro Mori, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 181 days.

(21) Appl. No.: 11/219,809

(22) Filed: Sep. 7, 2005

(65) Prior Publication Data

US 2006/0216081 A1 Sep. 28, 2006

(30) Foreign Application Priority Data

Mar. 22, 2005 (JP) ..... 2005-081901

(51) Int. Cl.
*G03G 15/20* (2006.01)

(52) U.S. Cl. ..... 399/336; 399/337

(58) Field of Classification Search ..... 219/216; 399/320, 335, 336, 337, 341

See application file for complete search history.

(56) References Cited

U.S. PATENT DOCUMENTS 4,897,691 A * 1/1990 Dyer et al. ..... 399/156

FOREIGN PATENT DOCUMENTS

| | | |
|---|---|---|
| JP | 57-049975 | 3/1982 |
| JP | 04-208974 | 7/1992 |
| JP | 05-341665 | 12/1993 |
| JP | 06-148989 | 5/1994 |

* cited by examiner

*Primary Examiner*—Hoang Ngo
(74) *Attorney, Agent, or Firm*—Morgan, Lewis & Bockius LLP

(57) ABSTRACT

A fixing device that applies heat energy to a recording medium having a toner image formed thereon to fix the toner image includes a flash fixing part that includes a flash lamp disposed in non-contact with the recording medium and applies heat energy to the toner image formed on the recording medium through discharge luminescence of a gas in the flash lamp, and an air stream spraying part that is disposed in non-contact with the recording medium on a downstream side of the flash fixing part in a transporting direction of the recording medium and sprays an air stream at a prescribed temperature onto a surface of the recording medium.

12 Claims, 6 Drawing Sheets

FIXING DEVICE AND IMAGE FORMING APPARATUS USING THE SAME

BACKGROUND OF THE INVENTION (1) Field of the Invention

The present invention relates to a fixing device of an image forming apparatus utilizing the electrophotographic system or an electrostatic transfer system, such as a duplicator, a printer, a facsimile machine and a multifunction machine, and more specifically, it relates to a fixing device that fixes an image by using a flash lamp, and an image forming apparatus using the same.

(2) Description of the Related Art

In a printer that forms a toner image utilizing a dry electrophotographic system, an image is formed by transferring a toner in a powder form onto a recording medium, and the toner image on the recording medium is applied with fixing energy to melt the powder toner on the recording medium, whereby the toner image is fixed.

As a device for applying the fixing energy in a high-speed printer, particularly, such a flash fixing device is used that utilizes luminescent energy of a non-contact flash lamp capable of applying high energy without influence on delivery of the recording medium.

The flash lamp used in the flash fixing device is constituted by a glass lamp tube having an inert gas, such as xenon, sealed therein and electrodes on both ends thereof, and a trigger wire disposed in a linear form along the longitudinal outer surface of the lamp tube. A high voltage is applied between the electrodes of the lamp tube simultaneously with applying a high voltage to the trigger wire, so as to induce a discharge phenomenon between the electrodes to emit light from the flash lamp.

With increasing expectation of full-color printing with a high-speed printer due to the needs from the market, the toner attaching amount on a recording medium is necessarily increased based on such demands as "enhancement of the color gamut with color toners" and "realization of superposition printing with two or more colors". According to the demand, the flash fixing device capable of applying high energy also suffers a severe problem in increase of the toner attaching amount for obtaining good fixing quality.

For example, in the case where full-color fixing is to be carried out under the fixing conditions for a monochrome toner in the conventional system, fixing failure occurs in a full-color part (which has a large toner attaching amount) due to shortage of energy.

In the case where large light energy is applied to toners in a short period of time, on the other hand, the components of the toner are sublimated to adversely affect the image.

Under the circumstances, there is a demand for a fixing method capable of favorably fixing a color image with a large toner attaching amount (i.e., the toner is melted to smoothen the fixed surface, and the fixing property is improved).

SUMMARY OF THE INVENTION

The present invention has been made in view of the above circumstances and provides a fixing device and an image forming apparatus using the same that can improve the fixing speed and the fixing property with a fixing unit that is not in contact with a recording medium, and can smoothen the fixed surface.

According to an aspect of the invention, the fixing device that applies heat energy to a recording medium having a toner image formed thereon to fix the toner image includes a flash fixing part that includes a flash lamp disposed in non-contact with the recording medium and applies heat energy to the toner image formed on the recording medium through discharge luminescence of a gas in the flash lamp, and an air stream spraying part that is disposed in non-contact with the recording medium on a downstream side of the flash fixing part in a transporting direction of the recording medium and sprays an air stream at a prescribed temperature onto a surface of the recording medium.

BRIEF DESCRIPTION OF THE DRAWINGS

Embodiments of the invention will be described in detail based on the following figures, wherein.

DETAILED DESCRIPTION OF THE INVENTION

First Embodiment

A first embodiment of the invention will be described with reference to the drawings.

A schematic configuration of an image forming apparatus including a fixing device according to the invention will be described with reference to FIG. 1.

Figure 1:
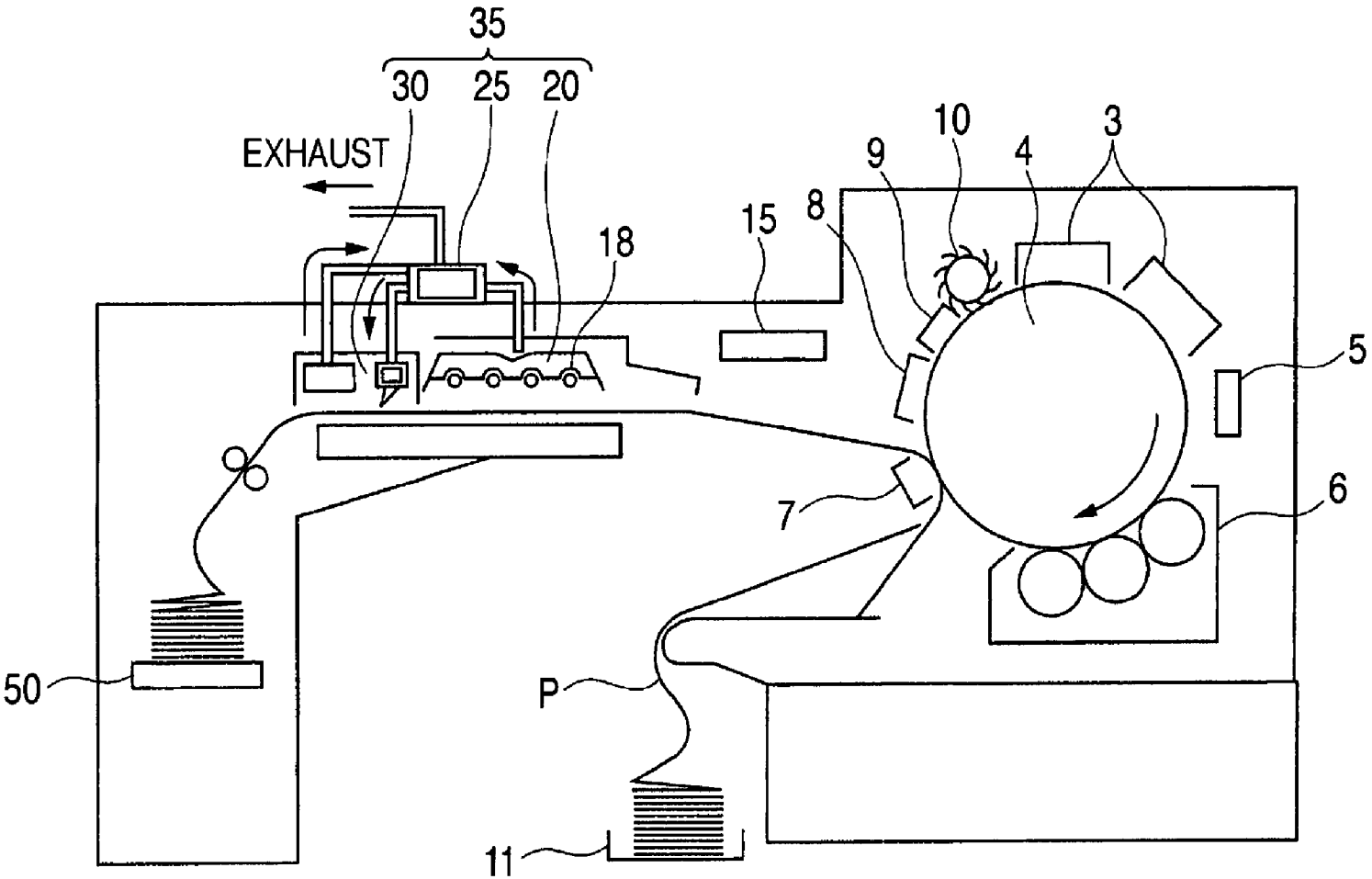
FIG. 1 is a schematic configurational view of a first embodiment of an image forming apparatus according to the invention.

In FIG. 1, continuous paper P as a recording medium housed in a paper tray 11 is continuously delivered from the paper tray 11 with a transporting mechanism, which is not shown in the figure, and inserted in a transfer nip part formed with a photoreceptor drum 4 and a transferring device 7 disposed to face the photoreceptor drum 4, so as to form a toner image on the continuous paper P. Thereafter, the toner image on the continuous paper P is fixed in a fixing device 35 disposed on the downstream side in the transporting direction, and the continuous paper P is housed in a stacker 50.

The photoreceptor drum 4 is formed rotationally, and around the photoreceptor drum 4, such electrophotographic devices are disposed as a charger 3, an exposing device 5, a developing device 6, the transferring device 7, a cleaning blade 8, a static eliminator 9 and a cleaning brush 10.

The operation of forming an image in the image forming apparatus of the embodiment having the aforementioned configuration will be described.

For example, the surface of the photoreceptor drum 4 formed rotationally in the clockwise direction is uniformly charged with the charger 3 and then exposed in the form of an image with the exposing device 5 having an optical system. According to the operation, an electrostatic latent image corresponding to the image is formed on the photoreceptor drum 4. The electrostatic latent image on the photoreceptor drum 4 is developed with the developing device 6, and then the toner image thus formed on the photoreceptor drum 4 is transferred to the continuous paper P with the transferring device 7.

After transferring, the photoreceptor drum 4 is discharged with the static eliminator 9, and the remaining toner is cleaned with the cleaning blade 8 and the cleaning brush 10 for preparing for the next image formation.

The continuous paper P having the toner image transferred thereon is subjected to a fixing step with the fixing device 35 and then housed in the stacker 50.

The fixing device 35 of the embodiment has a flash fixing unit 20, a hot air fixing unit 30 being disposed on the downstream side of the flash fixing unit 20 in the paper transporting direction, and a hot air controlling unit 25 intervening between the flash fixing unit 20 and the hot air fixing unit 30. The flash fixing unit 20 has a flash lamp 18 and executes flash fixing by melting the toner image on the paper P with luminescent energy of the flash lamp 18. The hot air fixing unit 30 sprays an air stream at a high temperature (hot air) onto the toner on the paper P melted with the flash fixing unit 20, whereby the fixing is accelerated, and the molten toner is fluidized to smoothen the surface of the molten toner. The hot air controlling unit 25 controls the amounts of heat recovered from and supplied to the units. The luminescence (luminescent frequency) of the flash lamp 18 in the flash fixing unit 20 is controlled with a flash controlling unit 15.

The configuration of the fixing unit 35 according to the invention will be described in more detail with reference to FIG. 2.

Figure 2:
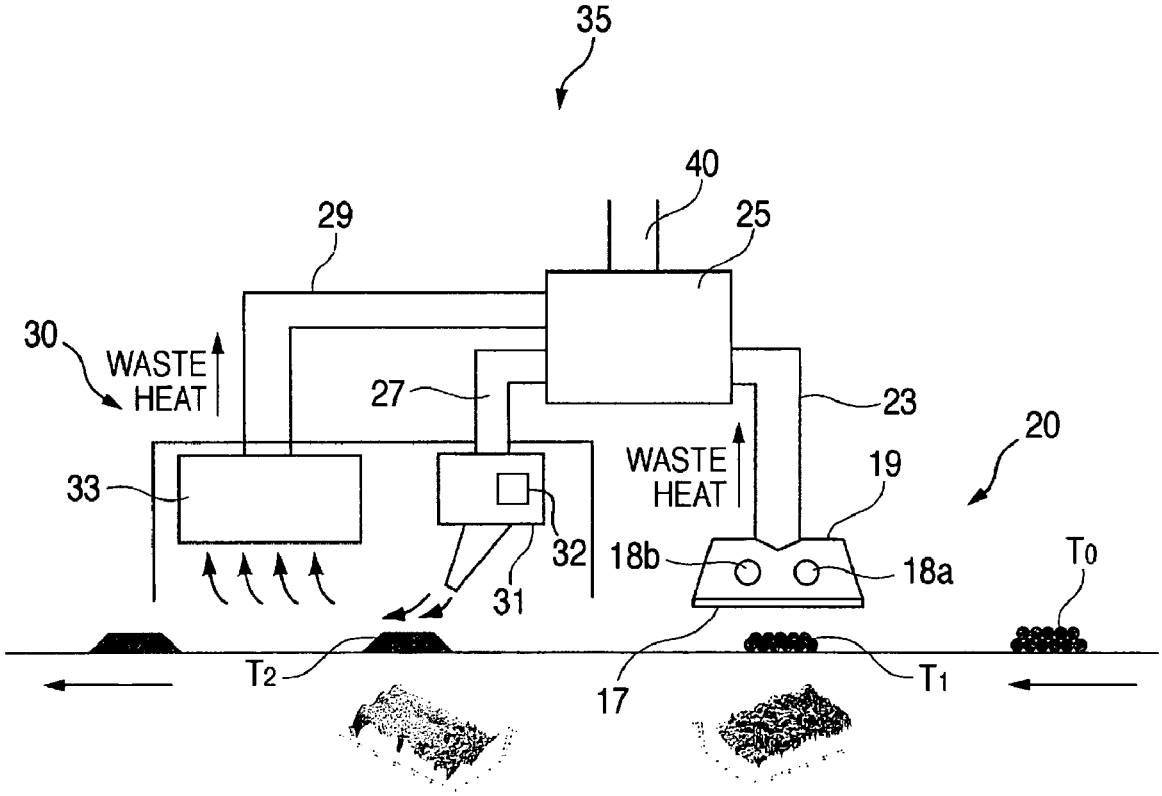
FIG. 2 is a schematic configurational view of a fixing device of the first embodiment of the invention.

As shown in FIG. 2, the fixing device 35 is constituted by the flash fixing unit 20 as the flash fixing part, the hot air fixing unit 30 as the air stream spraying part, the hot air controlling unit 25, and the other units. The flash fixing unit 20 disposed upstream in the paper transporting direction includes a cover glass 17 disposed to face the image forming surface of the continuous paper P in parallel thereto, flash lamps 18*a* and 18*b* (while two flash lamps are used in this embodiment, the number thereof is not limited as far as the necessary fixing energy is obtained) disposed along the direction approximately perpendicular to the paper transporting direction, and a reflector 19 disposed to cover the flash lamps 18*a* and 18*b*. The plural flash lamps 18*a* and 18*b* each has a lamp tube having an inert gas, such as xenon (Xe) gas, sealed therein and electrodes on both ends thereof, and a trigger wire disposed in a linear form along the outer surface of the lamp tube.

In the embodiment, the flash lamps 18*a* and 18*b* are disposed along the direction approximately perpendicular to the paper transporting direction. However, the disposing direction is not limited to the direction, and it is sufficient that the flash lamps are disposed approximately in parallel to the image forming surface of the paper P in non-contact with the paper P. For example, the flash lamps may be disposed along the paper transporting direction and may be disposed in a direction slanted to the paper transporting direction.

In the flash fixing unit 20 having the aforementioned configuration, a high voltage (trigger voltage) is applied to the trigger wire, and simultaneously a high voltage is applied to the electrodes of the lamp tubes, whereby the flash lamps 18*a* and 18*b* emit light. The light thus emitted is transmitted through the cover glass 17 or is once reflected by the reflector 19 and then transmitted through the cover glass 17, and thus the paper P is irradiated with luminescent energy to melt and fix the toner transferred onto the paper P.

In the flash fixing unit 20 of the embodiment, a part of the amount of heat (waste heat) radiated by luminescence of the flash lamps 18*a* and 18*b* is delivered to the hot air controlling unit 25 through a piping 23 provided on the upper part or the side surface of the reflector 19. The heat is supplied from the hot air controlling unit 25 to the hot air fixing unit 30 through a piping 27, and a part of the amount of heat in the hot air fixing unit 30 is again recovered as waste heat to the hot air controlling unit 25 through a piping 29, whereby such an apparatus configuration is realized that exerts high energy saving effect by utilizing waste heat.

The hot air controlling unit 25 controls the temperature of the hot air, for example, in such manners that, in the case where the paper P comes to a standstill, in order to prevent it from getting signal, the piping 27 for supplying an air stream to a nozzle 31 and an exhaust piping 40 are switched by a switching valve, which is not shown in the figure, and in the case where the temperature of the waste heat is low in the initial rise of the apparatus, the temperature is detected with a temperature sensor 32 provided inside the nozzle 31, and the air stream is auxiliarily heated with an auxiliary heater, which is not shown in the figure, provided inside the hot air controlling unit 25. The hot air controlling unit 25 also controls the flow rate (flow amount) of the air stream supplied to the nozzle 31.

The temperature control is carried out to optimize the temperature of the hot air corresponding to the thickness of the paper P and the attaching amount of the toner. Specifically, the optimum supplying conditions of hot air are determined in consideration of the printing speed, the fixing property and the target image quality, corresponding to the air flow amount of the hot air, the distance to the material to be heated (toner) and the physical property of the toner (softening point). For example, in the case where the printing speed is high to fail to assure a sufficient temperature increasing time, the necessary and sufficient heat energy is supplied by such a measure that the hot air zone is enhanced in the paper transporting direction.

The hot air fixing unit 30 in the embodiment has the nozzle 31 for spraying hot air, and an exhaust fan 33 for recovering a part of sprayed heat as waste heat. The nozzle 31 sprays hot air in the same direction as the paper transporting direction along the transporting direction, and waste heat of the hot air is recovered by the exhaust fan 33 disposed on the downstream side.

The temperature of the air flow sprayed from the nozzle 31 may be equal to or higher than the softening point of the toner $T_1$ (for example, from 80 to 130° C.) from the standpoint that the toner $T_1$ melted with the flash fixing unit 20 is not solidified. The flow rate of the air flow sprayed from the nozzle 31 may be such a value that provides a flow rate in the vicinity of the surface of the paper P equal to or higher than the transporting speed of the paper P (for example, from 0.5 to 3.0 m/s) from the standpoint that flow of the molten toner on the paper P is accelerated.

Furthermore, for example, such a configuration may be used that a thermoelectric conversion element is provided in the hot air fixing unit 30 or the flash fixing unit 20, whereby electric energy obtained by converting the heat energy is utilized as a power source of the auxiliary heater in the hot air controlling unit 25.

The function of fixing in the fixing device thus constituted according to the embodiment will be described with reference to FIG. 2.

In FIG. 2, the continuous paper P having the toner image transferred thereon is transported in the prescribed transporting direction (from right to left in the figure, in the embodiment).

The toner $T_0$ thus developed is attached to the paper P transported, to which strong light energy is applied with the flash fixing unit 20 to effect melting of the toner of the first step.

Subsequently, in the hot air fixing unit 30, a high-temperature air stream is sprayed from the nozzle 31 onto the paper P along the transporting direction, whereby melting of the whole toner is accelerated, and the molten toner is fluidized to smoothen the surface of the toner image.

In the fixing device 35 thus constituted according to the embodiment, the irregular surface of the toner image ($T_1$) immediately after the flash fixing (immediately after passing the flash fixing unit 20) is smoothened ($T_2$), and the adjacent toner particles are completely fused to each other, with the hot air fixing unit 30. Furthermore, the toner at the interface with the paper is decreased in viscosity to facilitate penetration into the paper fibers (i.e., the anchor effect), which brings about improvement in fixing property.

The nozzle 31 is constituted to spray a high-temperature air stream along the transporting direction of the paper P, whereby such an apparatus configuration can be conveniently realized that the flash fixing unit 20 is prevented from being exposed to the high-temperature air stream sprayed from the nozzle 31 to protect thermally the unit 20, and waste heat of the high-temperature air flow sprayed from the nozzle 31 is effectively recovered with the exhaust fan 33.

A surface state of an image fixed by using the fixing device 35 of the embodiment thus constituted will be described by comparing to the case where an image is fixed by using a conventional fixing device with reference to FIGS. 3A, 3B, 4A, 4B and 5.

Figure 3A:
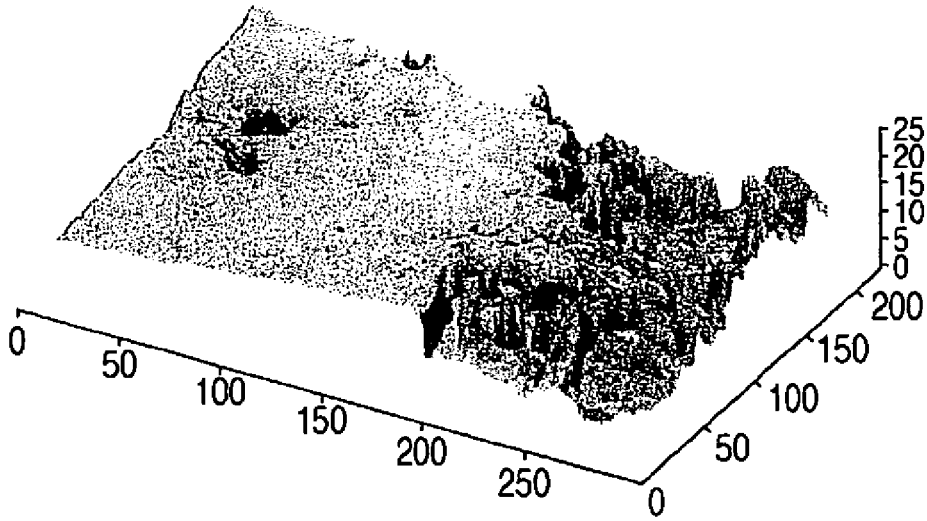
FIG.3A RELATED ART
FIGS. 3A and 3B are diagrams showing surface states of fixed images obtained by fixing with a heat roll fixing device of the related art.
Figure 3B:
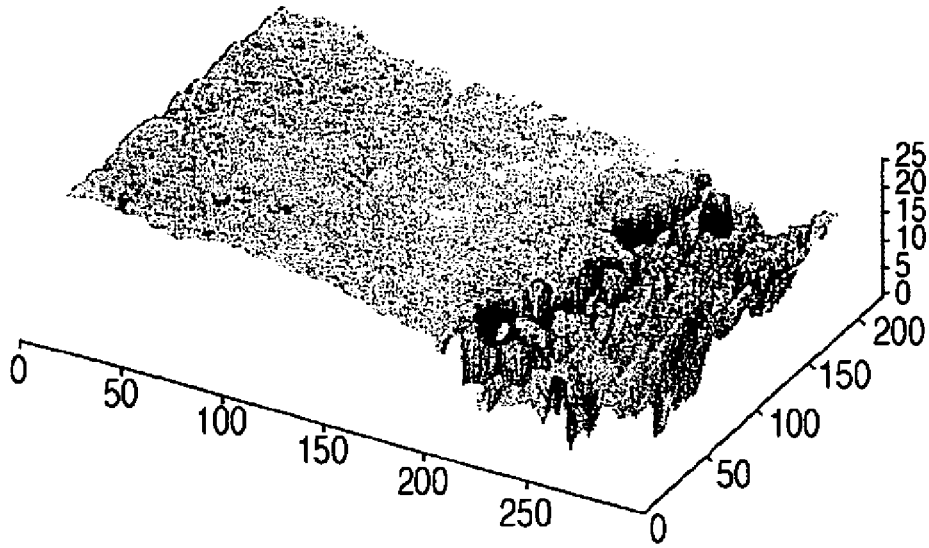
FIG.3B RELATED ART

FIGS. 3A and 3B are enlarged views of surface states of images fixed by using conventional heat roller fixing devices. Both the states shown in FIGS. 3A and 3B are enlarged views of surfaces of images fixed by using conventional heat roller fixing devices, but are obtained by using devices produced by different manufactures.

It is understood from FIGS. 3A and 3B that the surface state after fixing is smoothened by pressurizing the surface with the heat roller in both the devices produced by different manufactures.

Figure 4A:
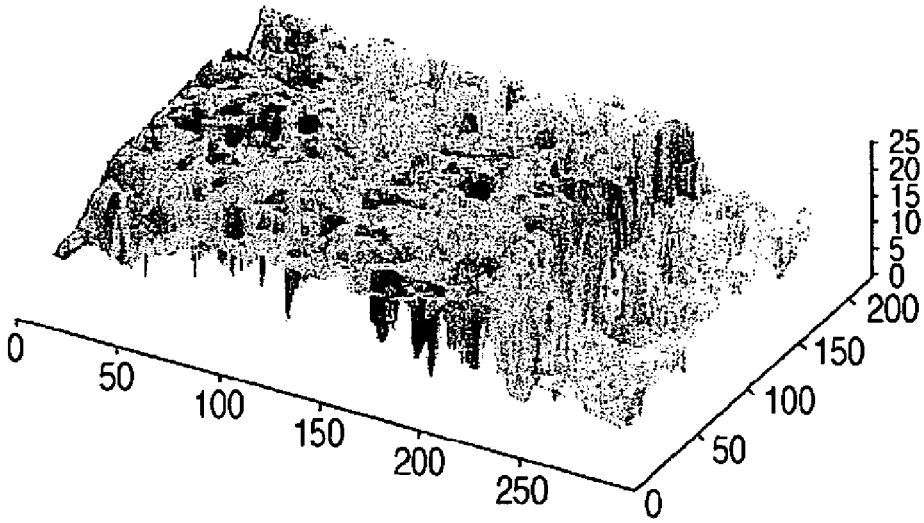
FIG.4A RELATED ART
FIGS. 4A and 4B are diagrams showing surface states of fixed image obtained by fixing only with flash fixing of the related art.
Figure 4B:
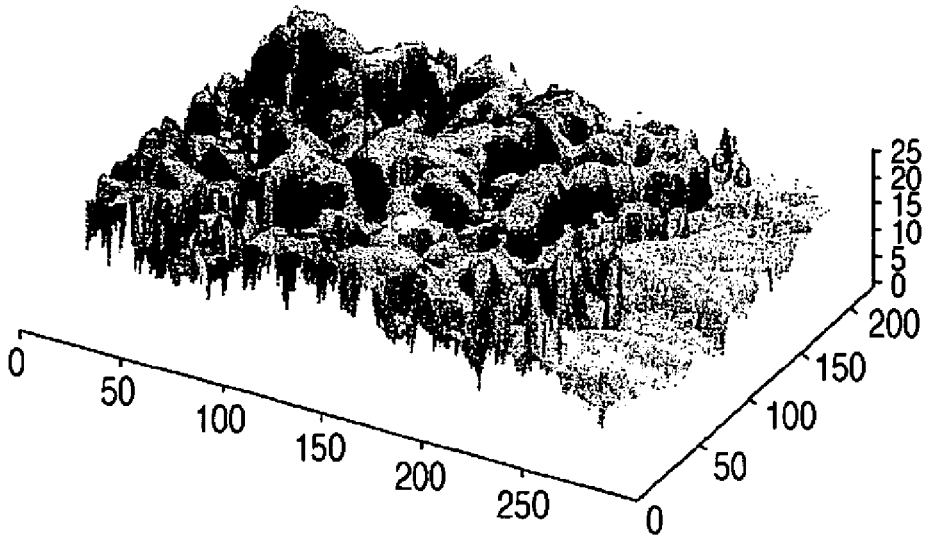
FIG.4B RELATED ART

FIGS. 4A and 4B show surface states of images fixed only with the flash fixing unit 20. FIG. 4A is an enlarged view of the surface state in the case where 55-kg paper is used, and FIG. 4B is an enlarged view of the surface state in the case where 135-kg paper is used.

It is understood from FIGS. 4A and 4B that large irregularity is formed on the surface only by flash fixing. In particular, it is understood that the 135-kg paper having a large thickness (i.e., a large heat capacity) (FIG. 4B) suffers larger irregularity under the same flash fixing conditions.

In the case where the fixing process is carried out only by the conventional flash fixing, a part of the toner forms islands on the surface of the image due to insufficient melting of the toner, and the toner in the form of islands is inferior in adhesion to the paper P and thus easily released from the paper P in a fixing property test, such as an adhesive tape releasing test.

Figure 5:
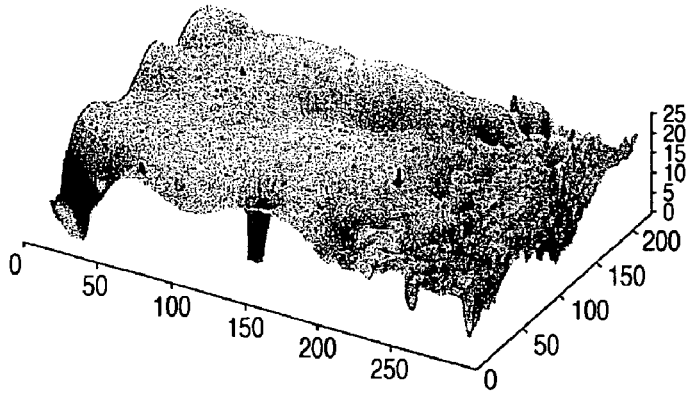
FIG. 5 is a diagram showing a surface state of a fixed image obtained by fixing with a fixing device according to the invention.

FIG. 5 shows a surface state of an image fixed by using the fixing device 35 according to the embodiment.

In the case where fixing is carried out by using the fixing device 35 according to the embodiment shown in FIG. 5, it is understood that the smoothness on the fixed surface is significantly improved as compared to the cases where the fixing is carried out only by the conventional flash fixing (as shown in FIGS. 4A and 4B).

Furthermore, as compared to the cases of fixing with a conventional heat roller fixing device (as shown in FIGS. 3A and 3B), it is also understood that the image fixed by using the fixing device 35 of the embodiment is prevented from suffering breakage of the toner and permeation unevenness of the toner due to excessive penetration thereof into the paper fibers.

Moreover, in the fixing device 35 according to the embodiment, the toner surface after the flash fixing is sprayed with hot air in addition to the light energy of the flash lamp 18, so as to smoothen the toner surface and to increase the temperature of the paper simultaneously with the temperature of the toner, whereby the fixing property is improved owing to the anchor effect of the toner into the paper fibers.

Specifically, problems, such as release of the toner, do not occur in the fixing property test, such as an adhesive tape releasing test. It is further understood that in addition to the anchor effect to the paper P, toner particles adjacent to each other, which are present in the form of particles only by flash fixing, are fused and integrated to each other with hot air to provide a scrum effect of increasing the cohesive force of the toner, whereby the fixing property is further improved.

In order to compare quantitatively the surface state of the image fixed only by flash fixing and the surface state of the image sprayed with hot air after fixing by flash fixing, a magenta toner is fixed by the respective fixing procedures, and the color gamuts thereof are expressed on a graph of a*-b* of the CIELAB color space. The results are shown in FIG. 6.

Figure 6:
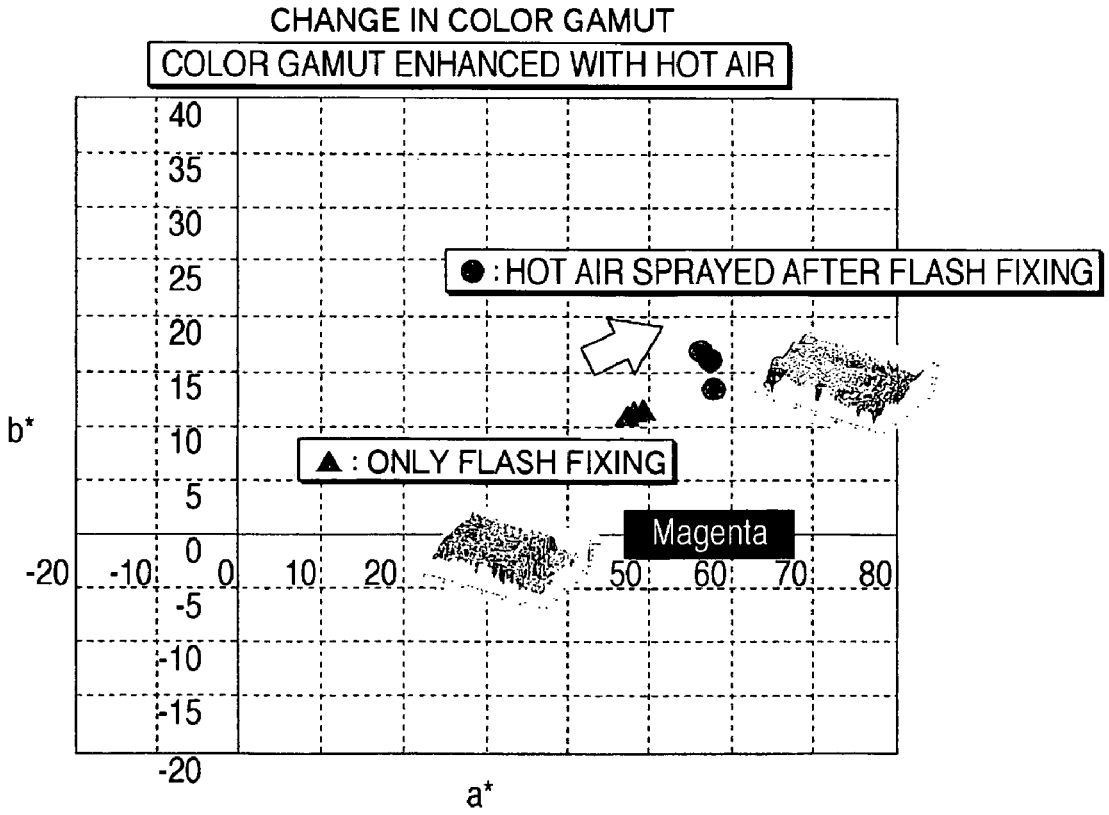
FIG. 6 is a graph of a*-b* of the CIELAB color space showing a color gamut obtained by fixing only with flash fixing of the related art and a color gamut obtained by fixing with a fixing device according to the invention.

It is apparent from FIG. 6 that the color gamut is enhanced by the improvement of surface smoothness in the case of the image fixed by using the fixing device 35 according to the embodiment. It is understood accordingly that the reproducible range of color is enhanced to improve the image quality of the fixed image.

Second Embodiment

A second embodiment of the invention will be described with reference to FIG. 7.

While the fixing device 35 according to the first embodiment is constituted by the flash fixing unit 20 and the hot air fixing unit 30, which are in separate bodies, a fixing device 35A in the second embodiment has an integrated unit structure including these units by changing the spraying direction of the nozzle 31. In FIG. 7, the members having the same functions as in the first embodiment are attached to the same symbols, and the detailed descriptions thereof are omitted herein.

Figure 7:
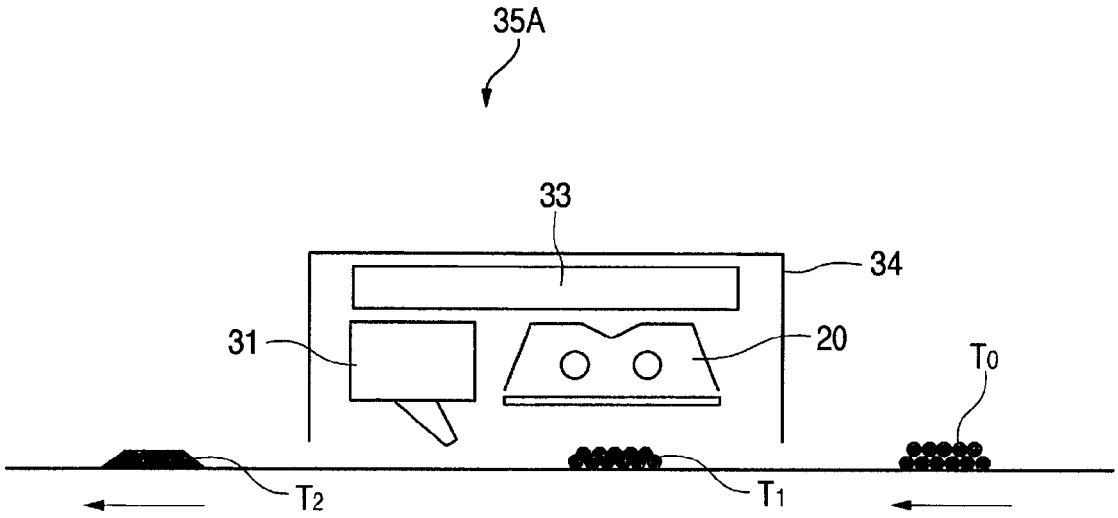
FIG. 7 is a schematic configurational view of a fixing device of a second embodiment of the invention.

As shown in FIG. 7, the fixing device 35A according to the embodiment has a nozzle 31 spraying hot air in a direction opposite to the paper transporting direction provided immediately next the flash fixing unit 20 on the downstream side thereof, and has an exhaust fan 33 disposed inside a unit chassis 34. The hot air controlling unit 25 may be disposed, for example, on the back side of the exhaust fan 33 as viewed in the figure, and parts thereof weak to heat, such as an electronic circuit, are disposed outside the unit chassis 34, whereby main components are accommodated by the unit chassis 34, so as to form into the integrated unit structure. The flow rate (flow amount) of the air flow sprayed from the nozzle 31 may be smaller than the flow rate of the air flow in the first embodiment to fluidize sufficiently the toner melted with the flash fixing unit 20 because the flow direction of the air flow faces (i.e., is opposite to) the moving direction of the paper P.

In the fixing device 35A thus constituted as shown in FIG. 7, the nozzle 31 is disposed to spray hot air in a direction opposite to the paper transporting direction, whereby flow of the toner molten by the flash fixing unit 20 is accelerated to smoothen the surface of the fixed image, and in addition, the device can be miniaturized and unitized. Furthermore, the flow amount of the high-temperature air stream sprayed from the nozzle 31 may be smaller than that in the case where the air stream is sprayed along the paper transporting direction to contribute to energy saving. Moreover, the exhaust fan 33 may be disposed on an upper part of the flash fixing unit 20, which suffers a high temperature, so as to attain cooling of the unit 20 and recovery of waste heat in the fixing device 35A.

It is confirmed that the fixing device 35A of the embodiment is good in smoothness, fixing property and image quality as being equivalent to the fixing device 35 of the first embodiment.

As described above, some aspects of the invention are outlined below.

According to an aspect of the invention, the fixing device that applies heat energy to a recording medium having a toner image formed thereon to fix the toner image includes a flash fixing part that includes a flash lamp disposed in non-contact with the recording medium and applies heat energy to the toner image formed on the recording medium through discharge luminescence of a gas in the flash lamp, and an air stream spraying part that is disposed in non-contact with the recording medium on a downstream side of the flash fixing part in a transporting direction of the recording medium and sprays an air stream at a prescribed temperature onto a surface of the recording medium.

The fixing device of the invention thus constituted as described above includes a flash fixing part that includes a flash lamp disposed in non-contact with the recording medium and applies heat energy to the toner image formed on the recording medium through discharge luminescence of a gas in the flash lamp, and an air stream spraying part that is disposed in non-contact with the recording medium on a downstream side of the flash fixing part in a transporting direction of the recording medium and sprays an air stream at a prescribed temperature onto a surface of the recording medium, whereby such a fixing device can be realized with a simple configuration that the speed of fixing can be increased by the fixing part that is disposed in non-contact with the recording medium, and simultaneously, the toner on the recording medium melted with the flash fixing part is fluidized with the air stream spraying part to improve the fixing property and the surface smoothness of the fixed image.

In the fixing device, the air stream may have a temperature equal to or higher than a softening point of the toner.

According to the configuration, the temperature of the air stream is equal to or higher than the softening point of the toner, whereby the flow of the toner on the recording medium melted with the flash fixing part can be accelerated without solidification of the toner.

In the fixing device, the air stream spraying part may spray the air stream along a transporting direction of the recording medium, and the air stream may have a flow rate equal to or higher than a transporting speed of the recording medium on the surface of the recording medium.

According to the configuration, the air stream spraying part sprays the air stream along a transporting direction of the recording medium, and the air stream has a flow rate equal to or higher than a transporting speed of the recording medium on the surface of the recording medium, whereby the flow of the toner on the recording medium is accelerated, and the high-temperature air stream by the air stream spraying part is prevented from being sprayed onto the flash fixing part of the upstream side, so as to provide such an apparatus configuration that the flash fixing part is thermally protected, and waste heat of the high-temperature air stream by the air stream spraying part can be easily recovered.

In the fixing device, the air stream spraying part may spray the air stream in a direction opposite to a transporting direction of the recording medium.

According to the configuration, the air stream spraying part sprays the air stream in a direction opposite to the transporting direction of the recording medium, whereby the flow of the toner on the recording medium is accelerated, and the air stream spraying part and the flash fixing part can be disposed closely to each other, so as to provide such an apparatus configuration that energy saving and miniaturization can be easily attained.

In the fixing device, the air stream spraying part may utilize waste heat upon heating with the flash fixing part.

According to the configuration, the air stream spraying part utilizes waste heat upon heating with the flash fixing part, whereby an apparatus configuration with higher energy saving effect can be provided.

In the fixing device, the air stream spraying part may have a temperature sensor and may control a temperature of the air stream corresponding to a detected result of the temperature sensor.

According to the configuration, the air stream spraying part has a temperature sensor and controls a temperature of the air stream corresponding to a detected result of the temperature sensor, whereby the temperature of the air stream can be controlled more precisely.

According to another aspect of the invention, the image forming apparatus includes an image forming device that forms a toner image on a recording medium and the aforementioned fixing device.

According to the invention, such a fixing device and an image forming apparatus using the same can be easily realized that can improve the fixing speed and the fixing property with the fixing unit that is not in contact with the recording medium, and can smoothen the fixed surface.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2005-081901 filed on Mar. 22, 2005 including specification, claims, drawings and abstract is incorporated herein by reference in its entirety.

What is claimed is:

1. A fixing device that applies heat energy to a recording medium having a toner image formed thereon to fix the toner image, the fixing device comprising:

a flash fixing part that comprises a flash lamp disposed in non-contact with the recording medium and applies heat energy to the toner image formed on the recording medium through discharge luminescence of a gas in the flash lamp; and an air stream spraying part that is disposed in non-contact with the recording medium downstream of the flash fixing part in a transporting direction of the recording medium and sprays an air stream at a prescribed temperature onto a surface of the recording medium.

2. The fixing device as claimed in claim 1, wherein the air stream has a temperature equal to or higher than a softening point of the toner.

3. The fixing device as claimed in claim 1, wherein the air stream spraying part sprays the air stream along a transporting direction of the recording medium, and the air stream has a flow rate equal to or higher than a transporting speed of the recording medium on the surface of the recording medium.

4. The fixing device as claimed in claim 1, wherein the air stream spraying part sprays the air stream in a direction opposite to a transporting direction of the recording medium.

5. The fixing device as claimed in claim 1, wherein the air stream spraying part utilizes waste heat upon heating with the flash part.

6. The fixing device as claimed in claim 1, wherein the air stream spraying part has a temperature sensor and controls a temperature of the air stream corresponding to a detected result of the temperature sensor.

7. An image forming apparatus comprising:

an image forming device that forms a toner image on a recording medium; and a fixing device comprising:

a flash fixing part that comprises a flash lamp disposed in non-contact with the recording medium and applies heat energy to the toner image formed on the recording medium through discharge luminescence of a gas in the flash lamp; and an air stream spraying part that is disposed in non-contact with the recording medium downstream of the flash fixing part in a transporting direction of the recording medium and sprays an air stream at a prescribed temperature onto a surface of the recording medium.

8. The image forming device of claim 7, wherein the air stream has a temperature equal to or higher than a softening point of the toner.

9. The image forming device of claim 7, wherein the air stream spraying part sprays the air stream along a transporting direction of the recording medium, and the air stream has a flow rate equal to or higher than a transporting speed of the recording medium on the surface of the recording medium.

10. The image forming device of claim 7, wherein the air stream spraying part sprays the air stream in a direction opposite to a transporting direction of the recording medium.

11. The image forming device of claim 7, wherein the. air stream spraying part utilizes waste heat upon heating with the flash part.

12. The image forming device of claim 7, wherein the air stream spraying part has a temperature sensor and controls a temperature of the air stream corresponding to a detected result of the temperature sensor.

* * * * *